US007628529B2

(12) United States Patent
Shoemaker et al.

(10) Patent No.: US 7,628,529 B2
(45) Date of Patent: Dec. 8, 2009

(54) SYSTEMS AND METHODS FOR MIXING PAINT

(75) Inventors: Terry Shoemaker, Florence, KY (US); Jason Jacob, Richmond, KY (US); Rick Morgan, Harrodsburg, KY (US); Scott Blatter, Lexington, KY (US); Phil Schmidt, Dry Ridge, KY (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 320 days.

(21) Appl. No.: 11/192,566

(22) Filed: Jul. 29, 2005

(65) Prior Publication Data

US 2007/0023343 A1 Feb. 1, 2007

(51) Int. Cl.
*B01F 7/22* (2006.01)
*B01F 15/02* (2006.01)

(52) U.S. Cl. ..... 366/155.1; 239/142; 137/571

(58) Field of Classification Search ..... 366/154.1, 366/155.1, 163.1, 163.2, 182.4, 290, 291, 366/136, 137; 239/142; 137/571
See application file for complete search history.

(56) References Cited

U.S. PATENT DOCUMENTS 2,266,143 A * 12/1941 Almquist ..... 137/426
2,679,982 A * 6/1954 Thyle ..... 241/46.17
2,685,499 A * 8/1954 Hood ..... 423/554
2,863,465 A * 12/1958 Shoemaker et al. ..... 134/104.4
3,181,931 A * 5/1965 Weber ..... 423/320
3,266,871 A * 8/1966 Kenkichi et al. ..... 422/253
3,438,215 A 4/1969 Frijlink
3,572,649 A * 3/1971 Joel ..... 366/136
3,889,850 A * 6/1975 Whitt ..... 222/135
4,543,978 A 10/1985 Laverman et al.
4,595,474 A * 6/1986 Greco ..... 204/232
4,859,072 A * 8/1989 Fey et al. ..... 366/165.4
5,046,856 A * 9/1991 McIntire ..... 366/291
5,309,403 A 5/1994 Bartow
5,590,960 A 1/1997 Clinton et al.
5,813,760 A 9/1998 Strong
6,203,183 B1 3/2001 Mordaunt et al.
6,494,608 B1 12/2002 Retamal et al.
2004/0125688 A1 * 7/2004 Kelley et al. ..... 366/152.2

* cited by examiner

*Primary Examiner*—David L Sorkin
(74) *Attorney, Agent, or Firm*—Dinsmore & Shohl LLP

(57) ABSTRACT

A tank apparatus for mixing paint including a mix compartment, a circulation compartment, a partition between the mix compartment and the circulation compartment, and a transfer assembly in fluid communication with the mix compartment and the circulation compartment, whereby the transfer assembly has an opening to selectively transfer mix paint from the mix compartment to the circulation compartment of the tank apparatus.

16 Claims, 3 Drawing Sheets

SYSTEMS AND METHODS FOR MIXING PAINT

FIELD OF THE INVENTION

This invention relates to systems and methods for mixing paint for delivery to paint spray booths.

BACKGROUND OF THE INVENTION

In the automobile industry, automobiles are painted within a paint spray booth at a point along an assembly line. Paint used to coat the automobile is provided to a spray booth from paint systems utilizing storage tanks located outside of the booth through spray hoses within the booth. More particularly, current designs of paint systems generally utilize two tanks located in close proximity to the automobile production line. The first tank is generally referred to as a circulation tank and is configured to hold and circulate the circulation paint actually being utilized in the paint booth. The second tank is generally referred to as the mixing tank and is configured to mix the proper ratio of added paint and solvent (when required) to achieve a desired mixture before being added to the circulation tank. Paint is generally added to the mixing tank by lifting and pouring a 55 gallon drum of paint into the tank.

Issues arise with this system in that each tank, comprising an 85 gallon container for example, requires a great deal of floor space for storage as well as effort to pour the 55 gallon container of paint into the mixing tank for mixing with an additive. In addition, the prior systems require twice the number of components for operation (e.g., two tanks, two pumps, two lines, etc.) and consume more initial paint and cleaning material. Accordingly, there is a need for a paint mix system configured to conserve floor space, effort and reduce the cost of operation.

SUMMARY OF THE INVENTION

Accordingly, embodiments of the present invention can minimize problems associated with excessive components, wasted floor space, excess piping or excess consumed paint, as well as the overall cost of the operation.

According to one aspect, a tank apparatus for mixing paint is provided comprising a mix compartment and a circulation compartment separated by a partition therebetween. The apparatus further comprises a transfer assembly in fluid communication with the mix compartment and the circulation compartment to transfer mix paint from the mix compartment to the circulation compartment.

According to another aspect, a paint system configured to deliver paint to a spray booth is provided comprising a tank apparatus having a mix compartment and a circulation compartment. The system further comprising a transfer assembly in fluid communication with the mix compartment and the circulation compartment. The transfer assembly selectively transfers mix paint from the mix compartment to the circulation compartment and the paint booth receives circulation paint for application to an article.

According to another aspect, a method for delivering paint to a spray booth is provided comprising providing a tank apparatus having a mix compartment, a circulation compartment and a partition therebetween, providing supply paint to the mix compartment, mixing the supply paint within the mix compartment to produce mix paint, transferring the mix paint from the mix compartment to the circulation compartment to produce circulation paint, and delivering circulation paint from the circulation compartment to the spray booth.

Still other embodiments, combinations and advantages will become apparent to those skilled in the art from the following descriptions wherein there are shown and described alternative illustrative embodiments of this invention for illustration purposes. As will be realized, the invention is capable of other different aspects, objects and embodiments all without departing from the scope of the invention. Accordingly, the drawings and description should be regarded as illustrative only and not as restrictive.

BRIEF DESCRIPTION OF THE DRAWINGS

It is believed that the present invention will be better understood from the following description taken in conjunction with the accompanying drawings in which.

DETAILED DESCRIPTION OF ILLUSTRATIVE EMBODIMENTS

Figure 1:
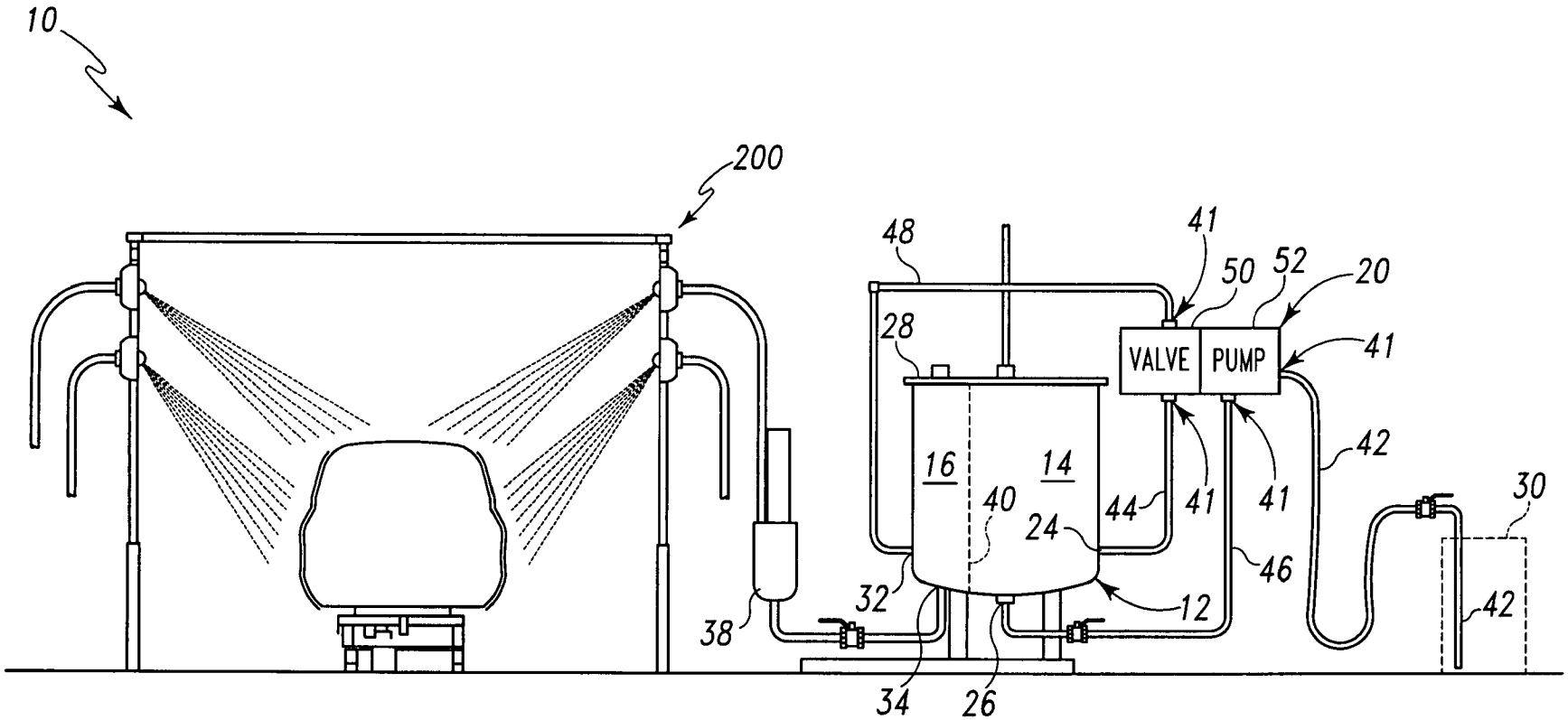
FIG. 1 is a front view of a paint system for delivering paint to a spray booth in accordance with one illustrative embodiment of the present invention.

Referring to the drawing figures in detail, wherein corresponding numerals indicate the corresponding elements throughout the drawings, FIG. 1 illustrates a system 10 for delivering paint or other coating to a paint spray booth 200 as comprising a tank apparatus 12 wherein paint is mixed and stored for delivery to paint spray booth 200. As illustrated and discussed more fully below, tank apparatus 12 comprises a mix compartment 14, a circulation compartment 16 and a transfer assembly 20. Paint may be mixed in mix compartment 14 as mix paint, and selectively transferred to circulation compartment 16 as circulation paint for delivery to paint spray booth 200 (i.e., an automobile paint spray booth). While it is contemplated that mix compartment 14 is intended to mix paint and solvent, where solvent is not required or other additives are desired, mix compartment 14 may also be employed to mix such additive or simply stir paint. As illustrated transfer assembly 20 is in fluid communication with compartments 14, 16 thereby facilitating fluid transfer to mix compartment 14 and between mix compartment 14 and circulation compartment 16.

Figure 2:
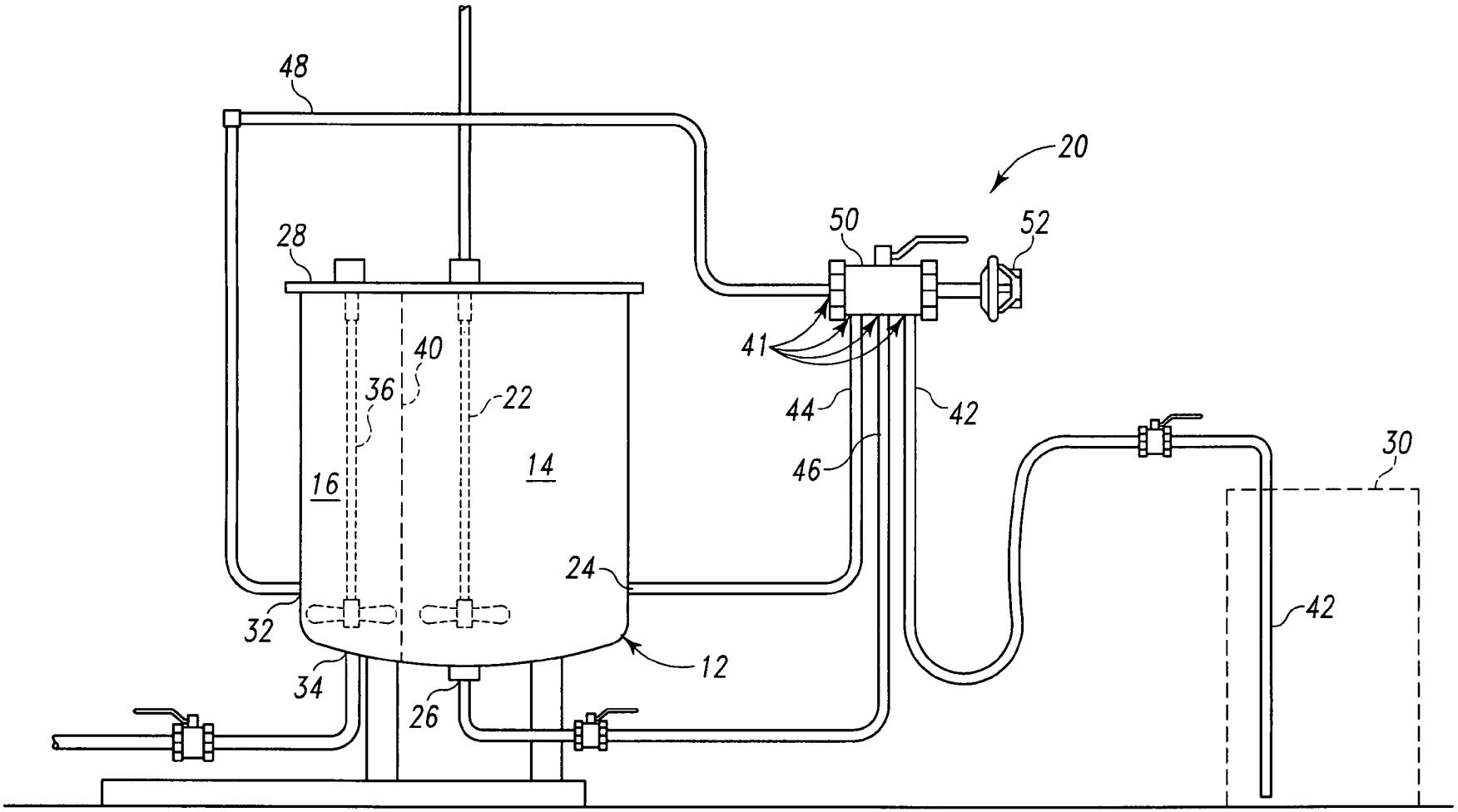
FIG. 2 is a front view of a tank apparatus in accordance with one illustrative embodiment of the present invention.
Figure 3:
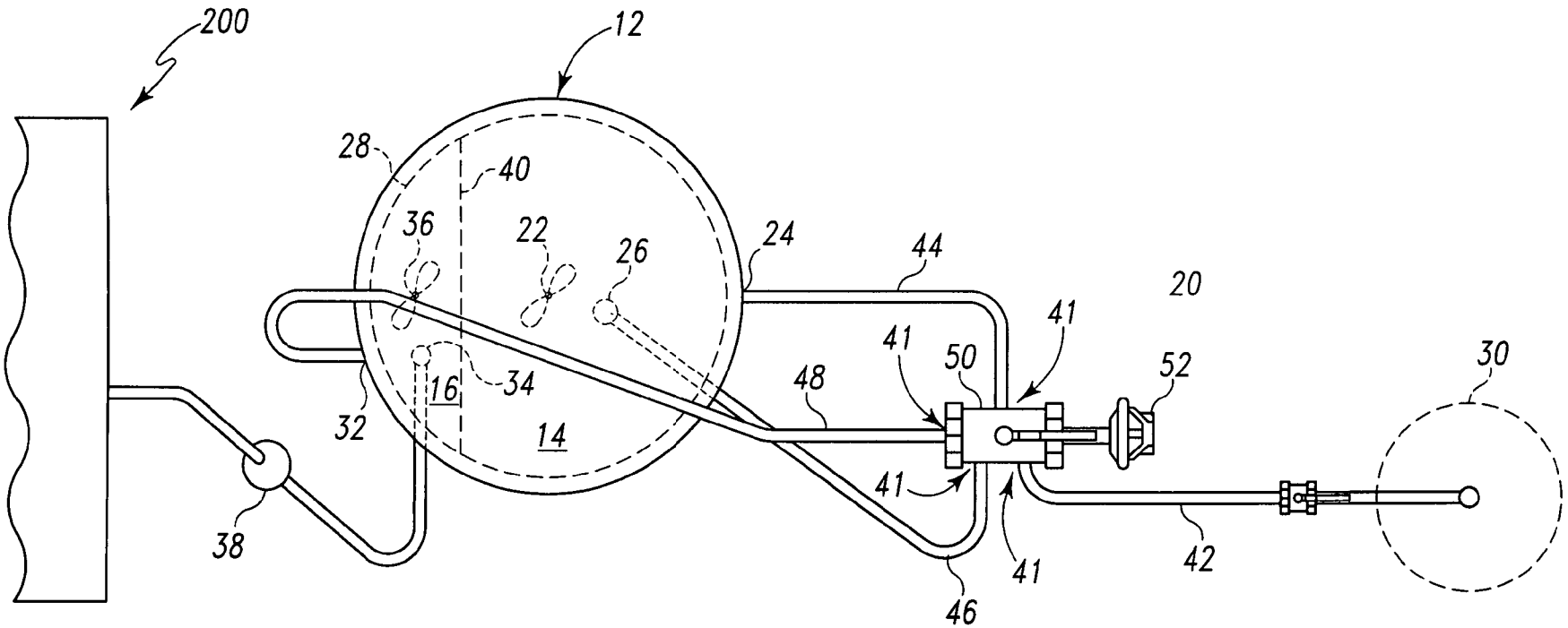
FIG. 3 is a top view of a tank apparatus in accordance with one illustrative embodiment of the present invention.

Referring to FIGS. 1-3, and as previously stated, tank apparatus 12 of system 10 is illustrated as comprising mix compartment 14 and circulation compartment 16. Between the mix and circulation compartments (14, 16 respectively), a partition 40 may be provided to effectively separate such compartments. As illustrated in the drawings, mix compartment 14, circulation compartment 16 and partition 40 may be substantially vertically disposed (e.g., the compartments and partition side-by-side) within tank apparatus 12. In another embodiment, mix compartment 14, circulation compartment 16 and partition 40 may be horizontally disposed (e.g., the compartments and partition one on top of the other) or diagonally disposed within tank apparatus 12. As illustrated, the tank apparatus 12 is bowl-shaped with two compartments discussed herein. However, it should be understood that the aspects of tank apparatus 12 relative to shape, material composition, number of compartments and disposition of the compartments may be modified to conform to various settings or applications. For example, tank apparatus 12 may be any shape such as a box, a sphere or a cone and may be made of any material such as steel, fiberglass, aluminum or polyethylene.

Still referring to FIGS. 1-3, partition 40 may be a vertically-oriented (e.g., from the top of the tank to the bottom) flat panel located such that circulation compartment 16 is approximately forty percent of the volume of mix compartment 14 (e.g., 25 gallons and 65 gallons, respectively). It should be understood that although partition 40 is illustrated as a vertically-oriented flat panel, alternative embodiments are contemplated. Partition 40 may be any shape or size such as, for example, a semi-circle of corrugated material. Partition 40 may also be oriented anywhere within tank apparatus 12 such as, for example, horizontally and thus may be employed to achieve any compartment shape, size, volume or orientation. In addition, partition 40 may be made of any material such as, for example, steel, fiberglass, aluminum or polyethylene. Partition 40 may be affixed using any approach known in the art which is suitable for the material such as, for example, metal welding, plastic welding, molding, or press fitting. Alternatively, partition 40 may be affixed to an individual compartment 14, 16 within tank apparatus 12, wherein each compartment 14, 16 is disengageable from tank apparatus 12 and therefore neither the compartment 14, 16 nor the partition 40 is affixed to tank apparatus 12. Of course, it should be understood that partition 40 may be a single plate wall, a two wall enclosure or may be any apparatus or assembly configured to separate compartments 14, 16 and that any quantity of partitions may be employed.

Still referring to FIGS. 1-3, transfer assembly 20 may be in fluid communication with container 30, mix compartment 14 and circulation compartment 16 such that paint may be selectively extracted and transferred therebetween. As illustrated in the exemplary embodiment, transfer assembly 20 may comprise a valve assembly 50 and a transfer device 52. In such an embodiment, transfer device 52 may selectively transfer paint while valve assembly 50 may guide paint to a user desired compartment. Transfer device 52 may be any apparatus capable of transferring fluid such as an electric pump, a hand-crank pump, or a siphon. Valve assembly 50 may be any apparatus capable of selectively stopping, limiting or changing the source or compartment with which transfer assembly 20 is in fluid communication. In one embodiment, valve assembly 50 may comprise a shut-off valve or a three-way valve. In addition, valve assembly 50 may be arranged in any configuration appropriate for transferring mix paint to circulation compartment 16 or for extracting paint from container 30.

Although transfer assembly 20 is illustrated as comprising valve assembly 50 and transfer device 52 and as being in fluid communication with container 30, mix compartment 14 and circulation compartment 16, alternative embodiments are contemplated. For example, transfer assembly 20 may only be in fluid communication with the mix compartment 14 and circulation compartment 16 such that supply paint must be provided to mix compartment 14 manually. In addition, in the alternative embodiment where compartments 14, 16 are horizontally disposed (e.g., one compartment on top of the other), transfer assembly 20 may comprise only valve assembly 50, whereby paint may be selectively transferred to or from compartments 14, 16 via gravity. Additionally, in the aforementioned embodiment, transfer assembly 20 may comprise only an opening whereby mix paint may be selectively transferred from mix compartment 14 to circulation compartment 16 via gravity.

It should be understood that paint may be selectively transferred through transfer assembly 20 via manual selection, user selection or automated selection. In selectively transferring paint via manual selection, a user may manually operate valve assembly 50 to stop, limit or change the source or compartment with which transfer assembly 20 is in fluid communication and/or manually operate transfer device 52 to initiate paint transfer. In selectively transferring paint via user selection, a user may direct a control system to operate valve assembly 50 to stop, limit or change the source or compartment with which transfer assembly 20 is in fluid communication and/or direct a control system to operate transfer device 52 to initiate paint transfer. In selectively transferring paint via automated selection, an automated system may be implemented which would operate valve assembly 50 to stop, limit or change the source or compartment with which transfer assembly 20 is in fluid communication and/or operate transfer device 52 to initiate paint transfer based on a defined variable such as viscosity, dilution or conductivity.

As illustrated in FIG. 2, mix compartment 14 may be configured such that supply paint from another source (e.g., container 30) may be provided to mix compartment 14, mixed therein and selectively transferred to circulation compartment 16. Mix compartment 14 may include a supply opening 24 associated with transfer assembly 20 such that paint may be extracted from container 30 (e.g., 55 gallon drum of supply paint), selectively transferred through transfer assembly 20 and provided to mix compartment 14. Although the supply opening 24 is illustrated as being associated with transfer assembly 20, alternative embodiments are contemplated. For example, supply opening 24 may be relocated such that paint may be provided to mix compartment 14 by pouring paint into supply opening 24. In addition, mix compartment 14 may comprise a plurality of supply openings 24 to allow a plurality of paints/additives to be simultaneously provided to mix compartment 14 or to allow different supply methods to be employed (e.g., transfer assembly 20 for paint and a pour opening for other desired additive). Supply opening 24 may be positioned, sized or configured in any manner conducive to providing paint to mix compartment 14 and may even be absent from tank apparatus 12.

Still referring to FIG. 2, and further described later herein, extraction opening 26 may similarly be associated with transfer assembly 20 such that mix paint may be extracted from mix compartment 14, may be selectively transferred through transfer assembly 20 and may be supplied to circulation compartment 16. Similar to supply opening 24, it should be understood that although the extraction opening 26 is illustrated as being associated with transfer assembly 20, alternative embodiments are contemplated. As described above, extraction opening 26 may be disposed in partition 40 such that gravity extracts mix paint from mix compartment 14 through extraction opening 26 and into circulation compartment 16 when the compartments 14, 16 are horizontally disposed within tank apparatus 12. It should be noted that extraction opening 26 and transfer assembly 20 may be the same apparatus in such an embodiment. Also described above, extraction opening 26 may be provided within partition 40 such that transfer assembly 20 and extraction opening 26 are not the same apparatus and transfer assembly 20 extracts mix paint from mix compartment 14, through the extraction opening 26 and into circulation compartment 16. Of course, extraction opening 26 may be positioned, sized or configured in any manner conducive to extracting mix paint from mix compartment 14 and transferring it to circulation compartment 16 and may even be absent from tank apparatus 12.

As illustrated in FIGS. 1-3, a first agitator 22 may be positioned within mix compartment 14 such that the paint and additive provided to mix compartment 14 may be sufficiently stirred. First agitator 22, is illustrated as a motor driven propeller, but may be any apparatus or assembly configured to stir fluid. For example, first agitator 22 may be a paddlewheel, a reciprocating agitator, a mechanism for agitating or rotating the entire mix compartment 14, or any other apparatus or assembly capable of stirring fluid.

Still referring to FIGS. 1-3, circulation compartment 16 is configured such that mix paint from mix compartment 14 is selectively transferred to circulation compartment 16 and circulated therein for subsequent delivery to paint booth 200. To achieve this, circulation compartment 16 may include a supply opening 32, a second agitator 36, and an extraction opening 34. As illustrated in FIG. 2 and further described later herein, supply opening 32 may be associated with transfer assembly 20 such that mix paint may be extracted from mix compartment 14, selectively transferred through transfer assembly 20 and supplied to circulation compartment 16 through supply opening 32. As discussed with regard to mix compartment 14, it should be understood that although supply opening 32 is illustrated as connecting to transfer assembly 20, alternative embodiments are contemplated. For example, similar to extraction opening 26 of mix compartment 14, supply opening 32 may be provided within partition 40 such that gravity transfers mix paint from mix compartment 14, through supply opening 32, and into circulation compartment 16 when compartments 14, 16 are horizontally disposed within tank apparatus 12. It should be noted that supply opening 32 and transfer assembly 20 may be the same apparatus in such an embodiment. However, supply opening 32 may be provided within partition 40 such that transfer assembly 20 and extraction opening 34 are not the same apparatus and such that transfer assembly 20 selectively transfers mix paint from mix compartment 14 and into circulation compartment 16. When supply opening 32 of circulation compartment 16 is located within partition 40, supply opening 32 is also extraction opening 26 of mix compartment 14. Of course, supply opening 32 may be positioned, sized or configured in any manner conducive to transferring mix paint to circulation compartment 16 and may even be absent from tank apparatus 12.

As illustrated in FIGS. 2 & 3, a second agitator 36 may be positioned within circulation compartment 16 such that mix paint transferred to circulation compartment 16 may be sufficiently circulated for subsequent delivery to spray booth 200. Second agitator 36, is illustrated as a motor driven propeller, but may be any apparatus or assembly configured to stir fluid. For example, second agitator 36 may be a paddlewheel, a reciprocating agitator, a mechanism for agitating or rotating the entire circulation compartment 16 or any other apparatus or assembly capable of stirring fluid. Additionally, in an embodiment where mix compartment 14 and circulation compartment 16 are horizontally disposed within tank apparatus 12, the driving mechanism associated with first agitator 22 may also be associated with second agitator 36 such as, for example, one drive shaft rotating both first and second agitator 22, 36 propellers.

An extraction opening 34 may be associated with circulation compartment 16, such that circulation paint may be selectively extracted from circulation compartment 16 and delivered to paint booth 200. As illustrated in FIGS. 1 & 3, extraction opening 34 may be in fluid communication with paint booth supply system 38 in order to extract circulation paint from circulation compartment 16 and deliver it to paint booth 200. In such an embodiment, paint booth supply system 38 may comprise any apparatus capable of delivering fluid to paint booth 200, such as an electric pump, a hand-crank pump, or a siphon. In an alternative embodiment, extraction opening 34 may be absent from tank apparatus 12. Of course, extraction opening 34 may be positioned, sized or configured in any manner conducive to extracting circulation paint from circulation compartment 16 and delivering it to paint booth 200.

As previously discussed, transfer assembly 20 may be incorporated into system 10 and may be in fluid communication with compartments 14, 16 to selectively facilitate paint transfer. A passage assembly 41 comprising a plurality of passageways may be in fluid communication with transfer assembly 20 to facilitate such transfer. In the exemplary embodiment, passage assembly 41 may be implemented as a multitude of distinct fluid passageways such as, for example, a suction line 42, a mix hose 44, a mix extraction hose 46 and a circulation hose 48. However, it should be understood that each passageway associated with passage assembly 41 may be made of any material known in the art of fluid transfer such as, for example, rubber, PVC, copper, iron, or fiberglass.

As previously discussed, transfer assembly 20 may be in fluid communication with tank apparatus 12 by connecting one or all passageways of passage assembly 41 to transfer assembly 20. In the exemplary embodiment, mix hose 44 is connected to supply opening 24, mix extraction hose 46 is connected to extraction opening 26, circulation hose 48 is connected to supply opening 32 and suction line 42 is in fluid communication with container 30. This embodiment may be desired when transfer assembly 20 is located on the periphery of tank apparatus 12. However, in an alternative embodiment, transfer assembly 20 may be located within tank apparatus 12 and connected therein to supply openings 24, 32 and extraction opening 26 which are provided within partition 40. This embodiment may be implemented when compartments 14, 16 are horizontally disposed within tank apparatus 12 and gravity, rather than transfer device 52, transfers paint from the upper compartment to the lower compartment. In an additional alternative embodiment, when enclosure 28 is absent from tank apparatus 12, the openings of transfer assembly 20 (e.g., mix hose 44, mix extraction hose 46, etc.) may interact directly with the paint in compartments 14, 16 thereby eliminating any need for the corresponding openings (e.g., supply openings 24, 32 and extraction openings 26, 34). In addition, it should be understood that transfer assembly 20 may comprise any apparatus or assembly configured to transfer fluid from any given location.

In use, employing transfer assembly 20 and by operating transfer device 52, paint may be provided to mix compartment 14 from container 30 via suction line 42, through valve assembly 50, and through mix hose 44. Paint may be mixed in mix compartment 14, and by operating transfer device 52, mix paint may be selectively transferred through valve assembly 50, through mix extraction hose 46, to circulation hose 48 and to circulation compartment 16. This embodiment may be desired when each mix compartment 14 and circulation compartment 16 are vertically disposed (e.g., side-by-side) and when the supply paint is provided to mix compartment 14 via suction line 42.

In another embodiment, suction line 42 may be absent and supply paint may be provided to mix compartment 14 via user interaction (e.g., pouring). In yet another embodiment, and as previously discussed, when mix compartment 14 and circulation compartment 16 are horizontally disposed within tank 12, transfer device 52 may be excluded from the design and gravity may transfer paint from the upper compartment to the lower compartment. In this embodiment, as previously discussed, transfer assembly 20 may be provided within partition 40 wherein extraction opening 26, supply opening 32, and transfer assembly 20 all comprise the same opening in partition 40 and transfer assembly 20 selectively transfers paint therethrough.

The foregoing description of the various embodiments of the invention has been presented for the purposes of illustration and description. It is not intended to be exhaustive or to limit the invention to the precise form disclosed. Many alternatives, modifications and variations will be apparent to those skilled in the art of the above teaching. For example, the system for delivering paint to a spray booth in accordance with the present invention may extract paint from a container, combine paint and additive in one partition of a tank, selectively transfer paint to another partition of a tank, and circulate paint to be subsequently employed in a paint booth. Accordingly, while some of the alternative embodiments of the system for delivering paint to a spray booth have been discussed specifically, other embodiments will be apparent or relatively easily developed by those of ordinary skill in the art. Accordingly, this invention is intended to embrace all alternatives, modifications and variations that have been discussed herein.

What is claimed is:

1. A tank apparatus for mixing paint comprising:

a mix compartment;

a circulation compartment;

an enclosure disposed over the mix compartment and the circulation compartment;

a partition between said mix compartment and said circulation compartment and extending vertically downward from the enclosure, thereby separating the mixing compartment and the circulation compartment such that no mix paint passes through the partition; and a transfer assembly in fluid communication with said mix compartment and said circulation compartment, said transfer assembly comprising a pump disposed externally of said mix compartment and said circulation compartment, wherein said transfer assembly selectively transfers mix paint from said mix compartment to said circulation compartment of said tank apparatus, wherein said mix compartment, said circulation compartment, or both comprise at least one agitator for stirring paint.

2. The tank apparatus of claim 1, wherein said transfer assembly selectively provides supply paint to said mix compartment.

3. The tank apparatus of claim 1, wherein said transfer assembly comprises a valve assembly.

4. The tank apparatus of claim 3, wherein said valve assembly comprises a three-way valve.

5. The tank apparatus of claim 1, further comprising a suction line, wherein said suction line provides supply paint to said mix compartment.

6. The tank apparatus of claim 1, wherein said pump is in fluid communication with said mix compartment and is configured to provide supply paint to said mix compartment.

7. The tank apparatus of claim 1, wherein a volume of said circulation compartment is approximately forty percent of a volume of said mix compartment.

8. A paint system configured to deliver paint to a spray booth comprising:

a tank apparatus according to claim 1; and a paint booth, wherein said paint booth receives circulation paint for application to an article.

9. The system of claim 8, further comprising a passage assembly in fluid communication with said transfer assembly, said passage assembly having at least one passageway.

10. The system of claim 9, wherein said at least one passageway comprises a suction line, wherein said suction line provides supply paint to said mix compartment.

11. The system of claim 10, wherein said at least one passageway further comprises a circulation hose, wherein said circulation hose transfers paint from said mix compartment to said circulation compartment.

12. The system of claim 8, wherein a volume of said circulation compartment is approximately forty percent of a volume of said mix compartment.

13. A method for delivering paint to a spray booth comprising:

providing a tank apparatus according to claim 1;

providing supply paint to said mix compartment;

mixing said supply paint within said mix compartment to produce mix paint; and transferring said mix paint from said mix compartment to said circulation compartment to produce circulation paint, and delivering circulation paint from said circulation compartment to said spray booth.

14. The method of claim 13, further comprising providing a valve assembly for transferring paint between said mix compartment and said circulation compartment.

15. The method of claim 13, wherein a volume of said circulation compartment is approximately forty percent of a volume of said mix compartment.

16. The method of claim 13, further comprising providing a passage assembly in fluid communication with said transfer assembly, said passage assembly having at least one passageway.

* * * * *